US006352258B1

(12) United States Patent
Fitzgerald et al.

(10) Patent No.: US 6,352,258 B1
(45) Date of Patent: Mar. 5, 2002

(54) CHILD'S FEEDING BOWL

(76) Inventors: Paul Fitzgerald; Joy Fitzgerald, both of 3 The Close, Waterpark, Carrigaline, County Cork (IE)

( * ) Notice: Subject to any disclaimer, the term of this patent is extended or adjusted under 35 U.S.C. 154(b) by 0 days.

(21) Appl. No.: 09/362,112

(22) Filed: Jul. 28, 1999

(30) Foreign Application Priority Data

Jul. 28, 1998 (IE) ..... S980631

(51) Int. Cl.[7] ..... A63F 1/00

(52) U.S. Cl. ..... 273/138.1; 273/139; 273/287; 273/142 R

(58) Field of Search ..... 273/138.1, 139, 273/287, 141 R, 142 R

(56) References Cited

U.S. PATENT DOCUMENTS

| | | | | |
|---|---|---|---|---|
| 833,725 | A | | 10/1906 | Bawden |
| 943,162 | A | | 12/1909 | Sohlesinger |
| 973,186 | A | | 10/1910 | Fisher |
| 1,595,356 | A | | 8/1926 | Moseman |
| 2,096,825 | A | | 10/1937 | Roman |
| 2,462,686 | A | | 2/1949 | Stallard |
| 2,561,594 | A | | 7/1951 | Pokras |
| 3,070,371 | A | * | 12/1962 | Hearle |
| 3,211,458 | A | * | 10/1965 | Wells |
| 3,214,848 | A | | 11/1965 | Eycke |
| 3,356,369 | A | | 12/1967 | Stubbmann |
| 3,582,070 | A | * | 6/1971 | Breslow |
| 3,591,175 | A | * | 7/1971 | Glass |
| 4,460,179 | A | | 7/1984 | Hafer |
| 4,730,831 | A | | 3/1988 | De Sio |
| 4,941,665 | A | * | 7/1990 | Klamer |
| 4,986,757 | A | | 1/1991 | Mueller |
| 5,441,164 | A | | 8/1995 | Beck et al. |

* cited by examiner

*Primary Examiner*—Benjamin H. Layno
(74) *Attorney, Agent, or Firm*—Jacobson Holman, PLLC

(57) ABSTRACT

A child's feeding bowl which encourages a child to eat by playing a game of chance. The bowl includes separate food compartments for the food and for example a dice is tossed to chose the compartment that can be eaten out of. Other game playing devices can also be used such as a rotating indicator similar to a roulette wheel indicator.

7 Claims, 12 Drawing Sheets

FIG. 4
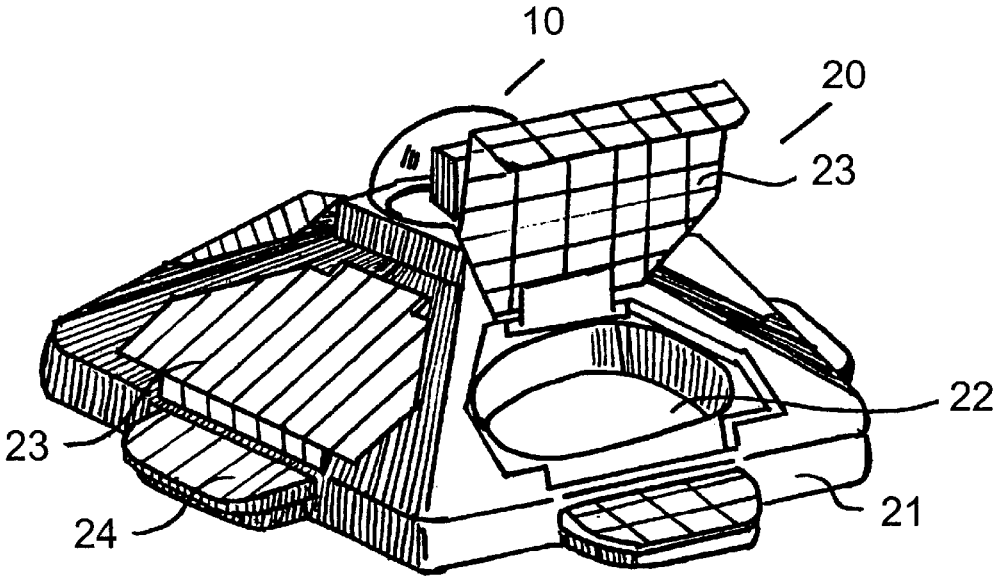
FIG. 3
FIG. 5
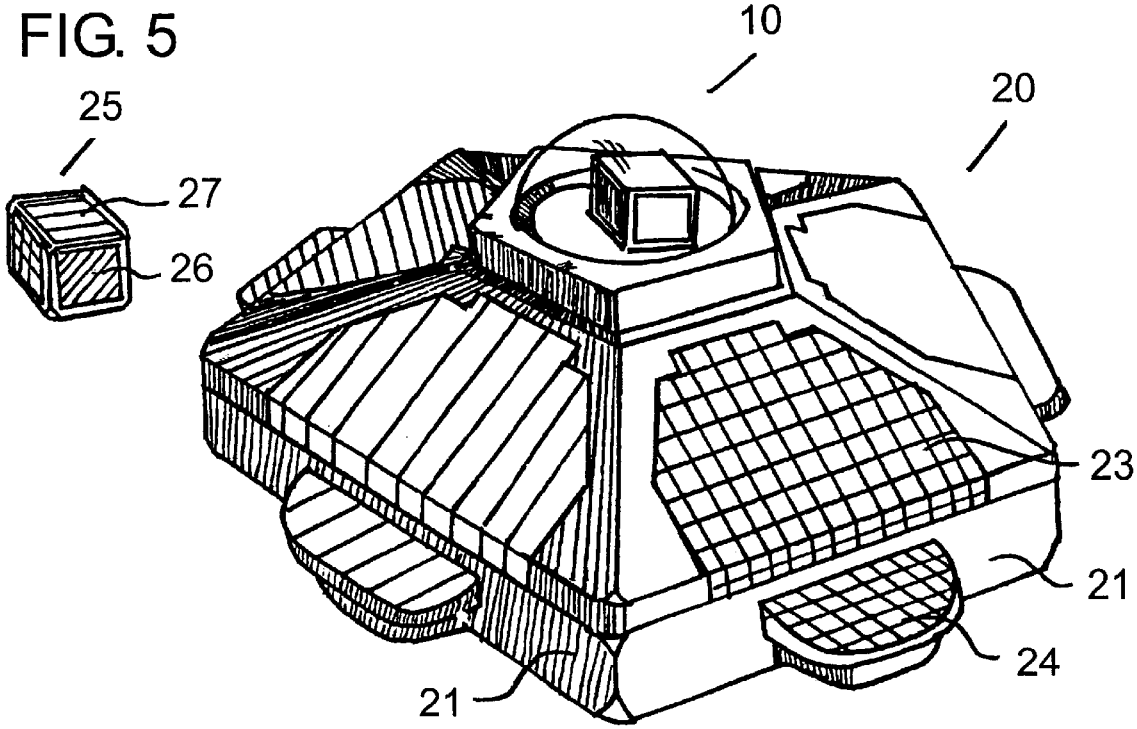

CHILD'S FEEDING BOWL

BACKGROUND OF THE INVENTION

The present invention is related to childcare and to the encouragement of children to eat and more specifically to a child's feeding bowl.

Feeding children is particularly difficult in that children can taken instant dislikes to particular types of food no matter how good, nutritionally, they are for them. It is known to form foods into various pleasing shapes, or incorporate them in novelties and the like devices in an effort to encourage the children to eat them. Thus, for example, many a cereal is provided in shapes of animals and various objects to encourage children to eat them.

In other instances, the packaging is constructed in a novel way to, for example, provide a toy or something that the children may play with, after the contents have been eaten. It does not take the child long to realise that if he or she wishes to have the toy, then what they must do is to dispose of the food as quickly as possible and preferably without any contact whatsoever with their stomach.

A further problem with the feeding of children is the low boredom threshold of most children who, while they may be amenable to eating their meal, generally get bored very quickly with the mundane task of eating.

It has long been recognized by child carers and in particular, child psychologists, that if children are to be encouraged to eat, then they must be encouraged by factors external to those that may drive an adult to eat such as nutrition, health improvement, enjoyment of the actual food and the like. While children may enjoy very sweet things such as confectionary, ices, etc., they, generally speaking, are not that keen on the taste of many a food which is required to provide them with a healthy balanced diet. It often takes many years and indeed there is many an adult, well out of his or her childhood, who still hankers after the food of his or her youth and will reject much more palatable and much more nutritious food.

It has long been appreciated that children enjoy playing games and if they can be encouraged to learn by playing games that this is particularly advantageous. For example there are many nutrition and exercise education games and methods of playing them, such as, for example, disclosed in U.S. Pat. No. 4,460,179 (Hafer), which shows essentially a target game which can teach players important dietary information. U.S. Pat. No. 4,986,757 (Mueller) is a board game aimed at three to six year olds which is designed to teach and promote good nutrition and exercise habits in the young. U.S. Pat. No. 2,561,594 (Pokras) illustrates an improved construction of child's dish which is adapted to retain a toy or some other prize for the child, which is received by the child only when he/she has eaten substantially all the food in the dish. However, all of these are of limited benefit. The latter U.S. Pat. No. 2,561,591 (Pokras) is probably of the most benefit in encouraging children in each, however, the construction is such is that it is relatively easy for the child not to eat the food and still obtain the prize.

OBJECTS

The present invention is directed towards providing means to encourage children to eat food and in particular to encourage them to eat food that they do not consider particularly palatable or more properly, food which their carers consider necessary that they should eat to ensure a nutritionally balanced diet.

SUMMARY OF THE INVENTION

According to the invention there is provided a child's feeding bowl comprising:

a base vessel;

a plurality of separate food compartments;

a chance controlled means for identifying a compartment for selecting a food compartment for a child; and operating means for causing the change controlled means to operate.

The advantage of this is that by using a chance control means for identifying a compartment the person supervising the feeding, whether it be a parent or a carer, has an opportunity to play a game with the child, or indeed cause the child to play the game and thus give some interest to the child in the feeding.

Ideally the child's feeding bowl comprises:

a central core portion for the base vessel;

a plurality of food compartments arranged side-by-side around the central core portion in the base vessel;

an indicator means rotatably mounted on the core and capable of identifying a chosen compartment to form the chance controlled means and its operating means.

Essentially this indicator can operate somewhat similar to a roulette wheel indicator. The indicator can include a motor and can have for example a removable knob to present a visually attractive figure to a child such as a carbon character or an animal. Again this provides amusement and interest to the child.

It is also envisaged that the chidl's feeding bowl could comprise:

food compartments formed in a separate integral food vessel rotatable about the central core;

a motor for rotating the food vessel;

a cover removably mounted on the base vessel to cover the food compartments;

a closure in the cover forming a pivotal lid to expose the contents of one food compartment; and means associated with the motor to open the lid on completion of rotation of the food vessel.

The advantage of this is that the child can see all the other foods being presented, but cannot get at the foods and therefore will try to eat the food that has been presented to it in an efficient manner and will then want to play the game against in an affort to get the food he or she has already seen and desires to eat.

Preferably, different coloured lights can be mounted on the central core portion and there can be means provided to cause the lights to switch on and off as the food vessel rotates further attracting the child. Indeed the motor can be used to open the lid.

In another way of carrying out the invention, the child's feeding bowl may comprise:

food compartments formed on a separate turntable rotatable about the central core portion;

a motor for rotating the turntable;

a closure formed by a lid for each food compartment; and means associated with the motor to allow opening of one of the lids on stopping of the turntable after rotation by the motor.

When such a turntable is used, the food compartments formed in the turntable may represent any visually attractive object, such as, for example, transport vehicle shapes, train carriages and so on.

Ideally there may also be a separate compartment allowing a treat to be stored, which treat can only be accessed when the other compartments have had the food eaten from then.

In a still further embodiment of the invention, the child's feeding can comprise:

a base vessel;

a central core portion in the base vessel;

a plurality of food compartments arranged side-by-side around the central core portion on the base vessel, each compartment having a unique identifier formed by visible indicia;

a closure formed by a separate lid for each food compartment;

a dice agitator mounted on the central core; and a dice contained within the agitator and having indicia corresponding to the compartment indicia.

Using a dice and dice agitator allows the child to play the game himself or herself and is one of the simplest ways of carrying out the invention. Very often it is advantageous to provide five compartments and a dice having six faces, the indicia on one face corresponding to the indicia of all the compartments.

Ideally the food compartments are arranged in a separate integral dish having a plurality of partition walls, forming the food compartments and as mentioned above, biasing means may be provided with each closure toward the lid into an open position and similarly catch means and a release tab for each lid may also be provided suitably connected together for operation. Again this allows the child to carry out the active task of feeding himself or herself.

Again it is envisaged that differently coloured indicator lights may be associated with compartments and when operating the feeding bowl, the light may switch on and off, the lifts may be used to indicate a particular compartment that may be accessed, they may simple to bused to provide a pleasing show, or any other suitable arrangement.

Further the feeding bowl may also incorporate a music player which can play turns in certain situations.

While in many of the embodiments according to the invention the vessel will be circular in shape having a central core, this is not by any means essential, but any suitable shape may be used.

Further the invention provides a method for encouraging child to each comprising:

placing food in a number of separate food compartments or vessels; and playing a game of chance with the child so as to identify the compartment within which is the food which has to be eaten by the child.

As has been stated already, playing games with children is a pleasing task and therefore they tend to play games while eating and this encourages them to eat. Very often when playing the game the child in fact forgets that he or she is eating.

It is particularly advantageous that the food in the compartment is not necessarily visible to the children as this further increases the mystery and encourages the child to eat.

BRIEF DESCRIPTION OF THE DRAWINGS

The invention will be more clearly understood from the following description of some embodiments thereof, given by way of example only, with reference to the accompanying drawings, in which:

FIG. 3 is a perspective view of an alternative construction of feeding bowl according to the present invention;

FIG. 4 is another perspective view of the feeding bowl of FIG. 3 in a position for feeding;

FIG. 5 is a perspective view of a dice used with the feed bowl of FIGS. 3 and 4;

DETAILED DESCRIPTION OF THE INVENTION

Figure 1:
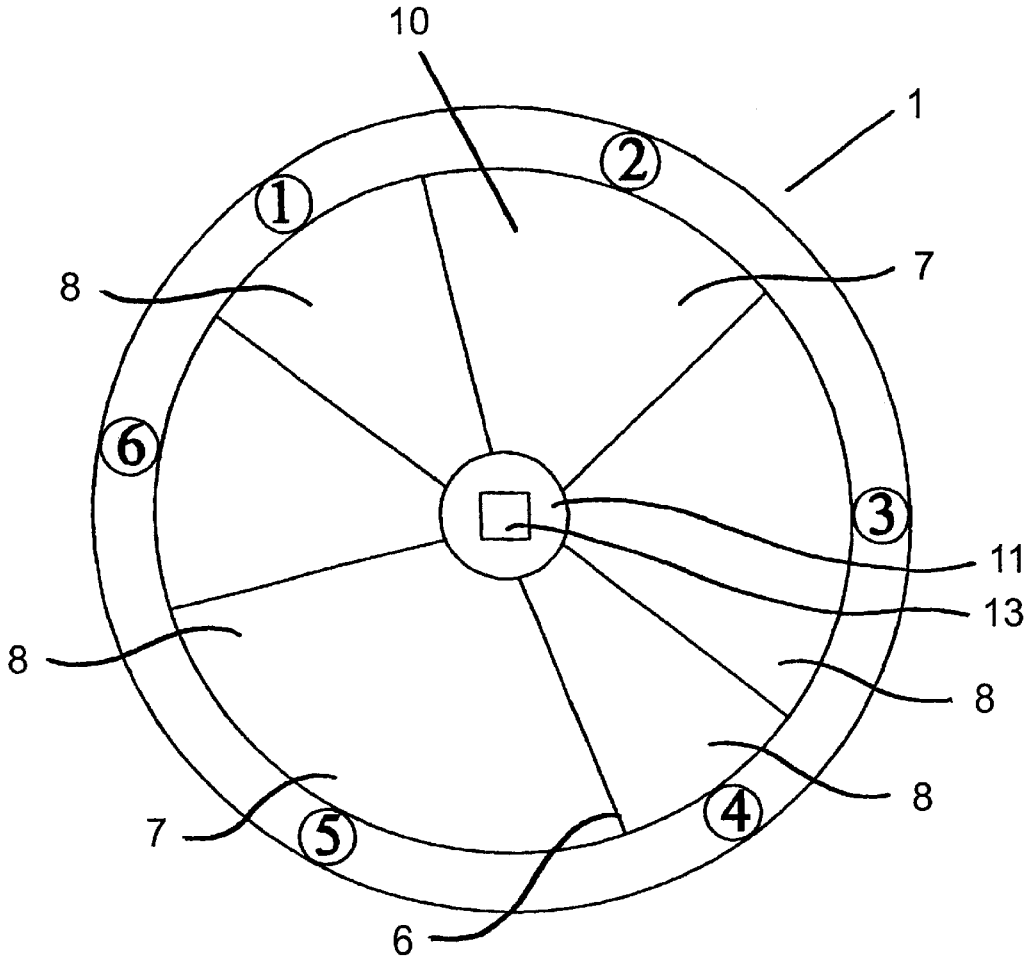
FIG. 1 is a plan view of a bowl according to the invention.
Figure 2:
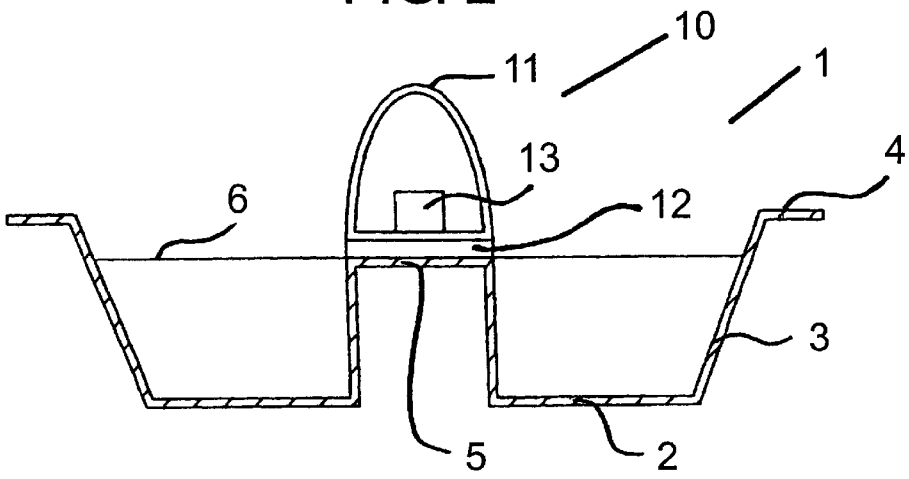
FIG. 2 is a vertical sectional view of the bowl.
Figure 6:
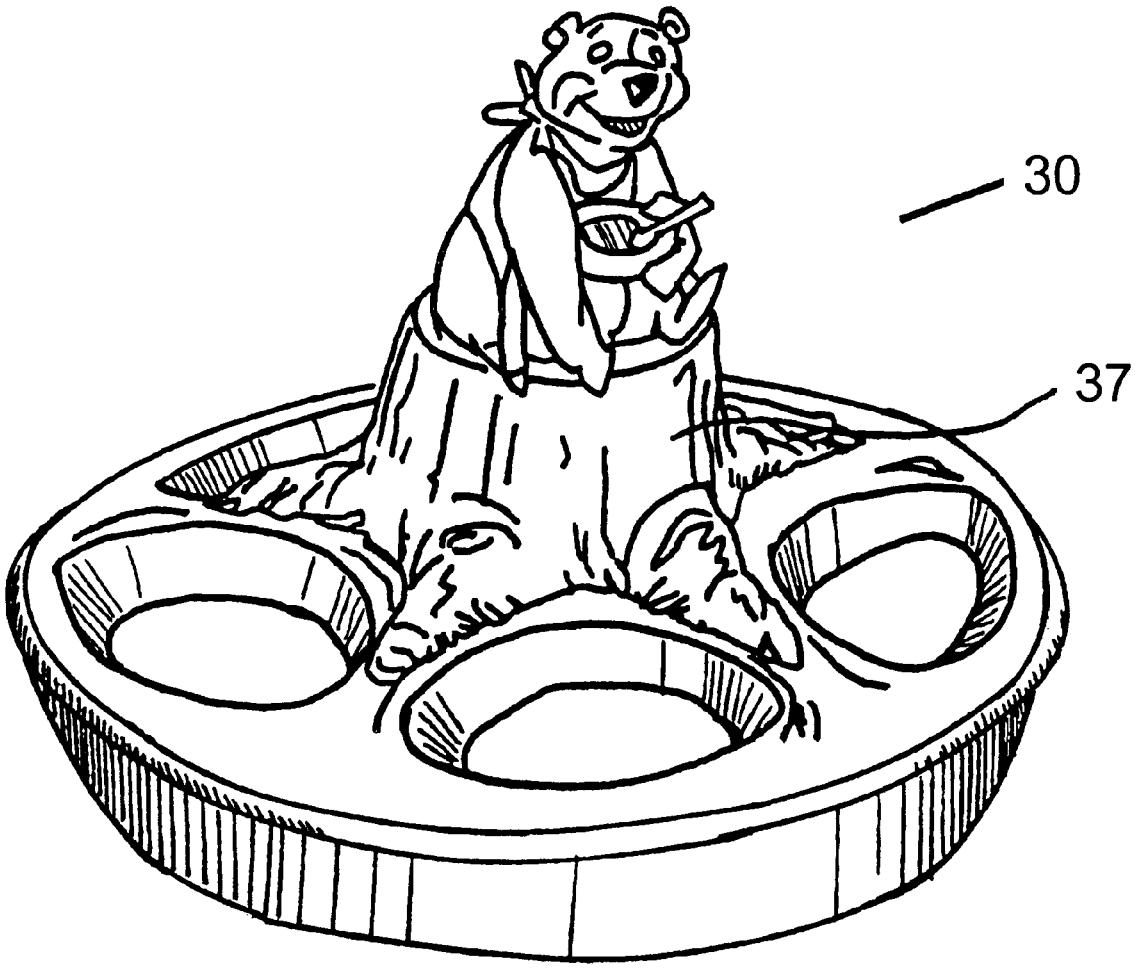
FIG. 6 is a perspective view of another feeding bowl according to the invention.
Figure 7:
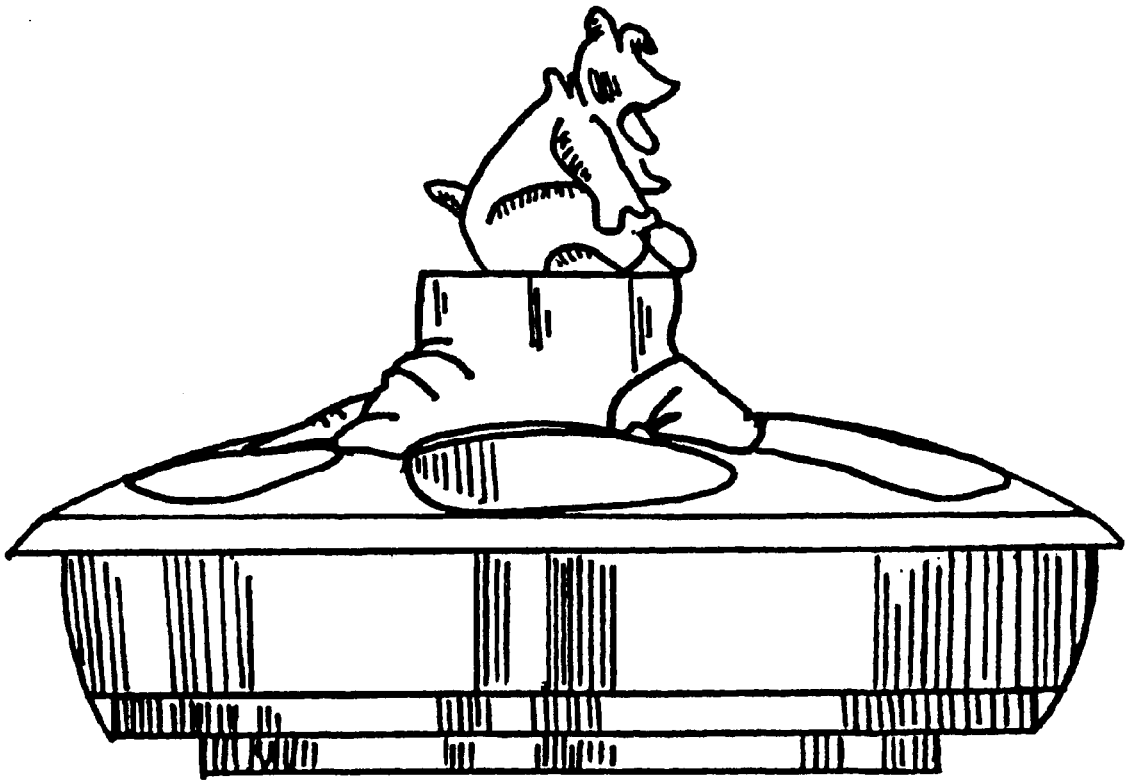
FIG. 7 is a side view of the feeding bowl of FIG. 6.
Figure 8:
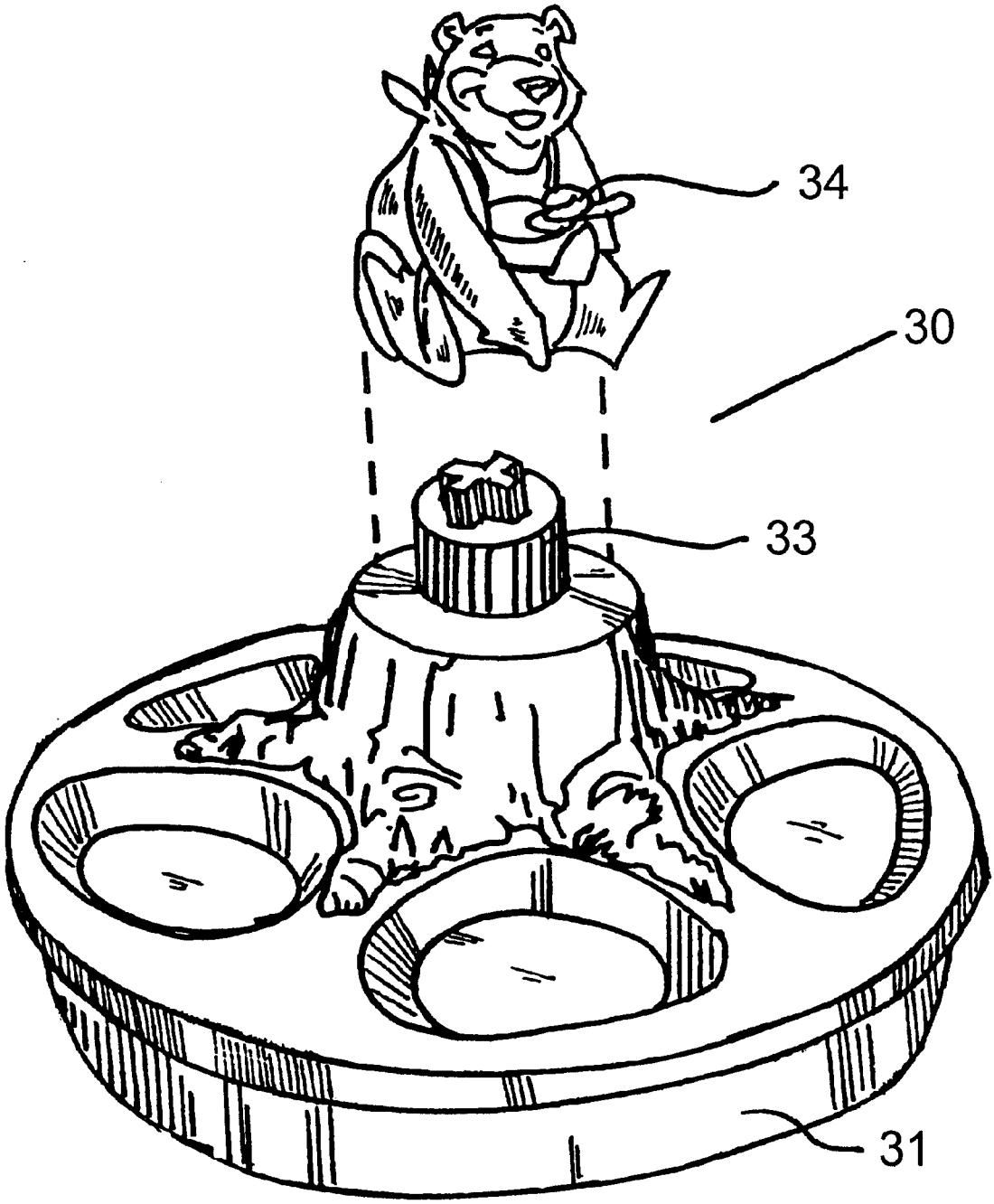
FIG. 8 is a partially exploded view of the feeding bowl of FIG. 6.
Figure 9:
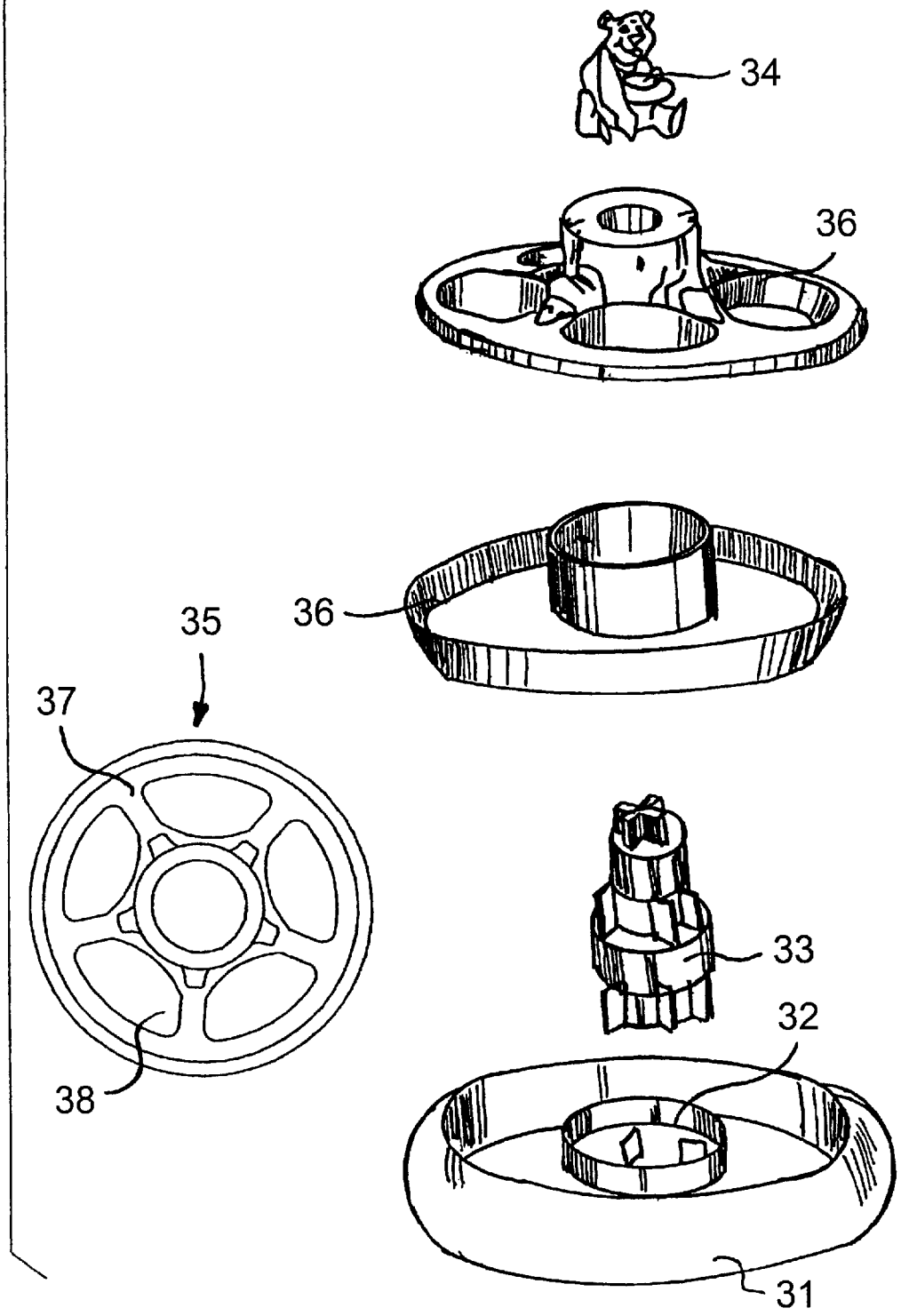
FIG. 9 is a still further exploded view of the bowl of FIG. 6.

Referring to the drawings and initially to FIGS. 1 and 2, there is provided a child's feeding bowl indicated generally by the reference numeral 1, which bowl incorporates a base vessel 2 having a peripheral side wall 3 terminating in a horizontal rim 4. The bowl 1 also has a central core portion 5 somewhat similar to the central hub of a wheel. Six radially arranged partition walls 6 extend from the core portion 5 to the peripheral side wall 3 to divide the bowl 1 into a series of separate food compartments indicated generally by the reference numerals 7 and 8. It will be noted that the compartments 7 which are opposite each other are slightly larger than the compartments 8. Further, it will be noted that on each rim adjacent each compartment 7 or 8, there is printed a number between one and six. These numbers are circled in the drawings to differentiate them from the identification numerals used in this specification and form a unique identifier means for each compartment.

Mounted on the central core 5 is a change controlled means in the form of a dice agitator, indicated generally by the reference numeral 10. The dice agitator 10 comprises a dome 11 of a suitable transparent plastics material movable up and down against a spring loaded base or tray 12 in the dice agitator 10, which spring loaded base moves to toss a dice 13 contained therein. The dice agitator 10 is detachably mounted on the core 5 to allow the dice to be tossed remote from the bowl or for cleaning the bowl 1. This is essentially a conventional dice agitator. Dice agitators are well known and generally comprise a reciprocally movable tray housed within a transparent enclosure to tumble a dice loosely disposed thereon. These are well known, for example, such an agitator is disclosed in U.S. Pat. No. 2,462,686 (Stallard). Indeed very often the reciprocal tray is manufactured from a left spring. The advantage of these dice agitator is that dice do not get lost. A further advantage for young children is that they cannot swallow the dice as they are housed within an enclosure. However, such dice agitators are so well known that they do not require any further explanation or description.

Various ways of feeding a child may be provided. For example, a typical child's dinner of meat divided into two small portions, could be placed in two compartments 8 such as the compartments identified as ① and ④; rice divided into two small portions and placed in two other compartments namely ③ and ⑥ and finally, vegetable placed in the compartments identified for the child as ② and ⑤. Each time the dice 13 is tossed, the child will have the choice to each from the particular compartment indicated by the dice. No further choices are allowed until all or sufficient of the food is eaten. Again a supervising adult can very the rules of the game as he or she deems fit.

Referring now to FIGS. 3 and 5 there is illustrated an alternative construction of feeding bowl substantially similar to the feeding bowl described with reference to FIGS. 1 and 2. Accordingly, parts similar to those described with reference to the previous drawings are identified by the same reference numerals. In this embodiment there is provided a child's feeding bowl indicated generally by the reference numeral 20. Essentially again this feeding bowl 20 comprises a base vessel having five upstanding peripheral walls 21. In this embodiment there is provided five food compartments 22. Each food compartment 22 has a closure formed by a separate lid 23 actuated by a release tab 24. The food compartments 22 are provided with a unique identifier usually provided by visible indicia. In this case the visible indicia giving the unique identifier is that the various lids 23 are coloured differently. This is shown by various cross-hatching and lines in the drawings. In this embodiment thee is provided a dice indicated generally by the reference numeral 25, five faces 26 of which are coloured to correspond to the colour of the lids 23 and tabs 24, while the last face 27 is blank, allowing the choice of any compartment. Each lid 23 which is pivotally mounted on the feeding bowl 20 has a suitable biasing means, not shown, to bias it into the open position and a catch means for holding the lid closed, which catch means is connected by a suitable mechanism to the release tab 24 for each lid 23. Colours may be easier for children to use, particularly young children and the idea of having only five compartments is that it allows the child a further element of chance in that he or she can select any compartment when the dice so allows, thus further increasing the element of chance for the child and making it more interesting.

Before referring to some of the following embodiments described, reference needs to be made to the term "motor" as used in this specification to include both mechanically or electrically driven motors or mechanisms and prime movers generally. It will also be appreciated that a mechanically driven motor may also combine the functions of a prime mover as well as that of a generator to power lights etc. However, it is envisaged generally that where the term motor is used in the sense of powering lights that it will more often be appropriate to use a battery rather than a mechanically operated motor.

A mechanically driven motor can be any clockwork-like, wind-up spring, inertia or friction operated motors all of which are used extensively in toys and which by their very nature and use i.e. by the way in which they are would up or otherwise primed and by their inherent qualities will operate randomly, thus stopping in effect by chance.

Similarly, where battery powered motors are used it will be readily easily appreciated that there are many well known cheap and simple devices which can be used in conjunction with a battery to provide a random operating time for a motor and thus the term "a random operating motor" or simply "motor" is used in this sense in this specification. Any further elaboration and description of these is irrelevant to the understanding of or to the carrying out of the invention. Thus, generally in this specification mechanisms and devices for mounting and operating the embodiments of the invention whether mechanical or electrical are not described in detail as they would merely confuse the reader since there are so many ways the invention can be carried out. In many cases to operate the invention some form of a short burst of relative rotary motion has to be imparted to a portion of a child's feeding bowl. This, it will be appreciated, does not require an elaborate prime mover, but many manually operated mechanisms will suffice.

Referring now to FIGS. 6 to 9 inclusive, there is illustrated an alternative construction of feeding bowl indicated generally by the reference numeral 30 formed from a base vessel 31 having a core 32 housing a motor 33 operated by a removal knob 34 in this case representing a visually attractive figure for a child, namely a bear. Mounted about the core 32 is an integral food vessel 35 having a plurality of separate food compartments 36. A cover plate 37 having access apertures 38 is mounted above the food vessel 35 and engages the base vessel 31. In this embodiment the motor 33 is a simple wind-up spring actuated motor. It could be of any construction. It will be noted that the feeding bowl 30 can be readily easily disassembled for cleaning. It will also be appreciated that the knobs 34 can be replaced knobs illustrating different characters or animals or inanimate objects.

Figure 10:
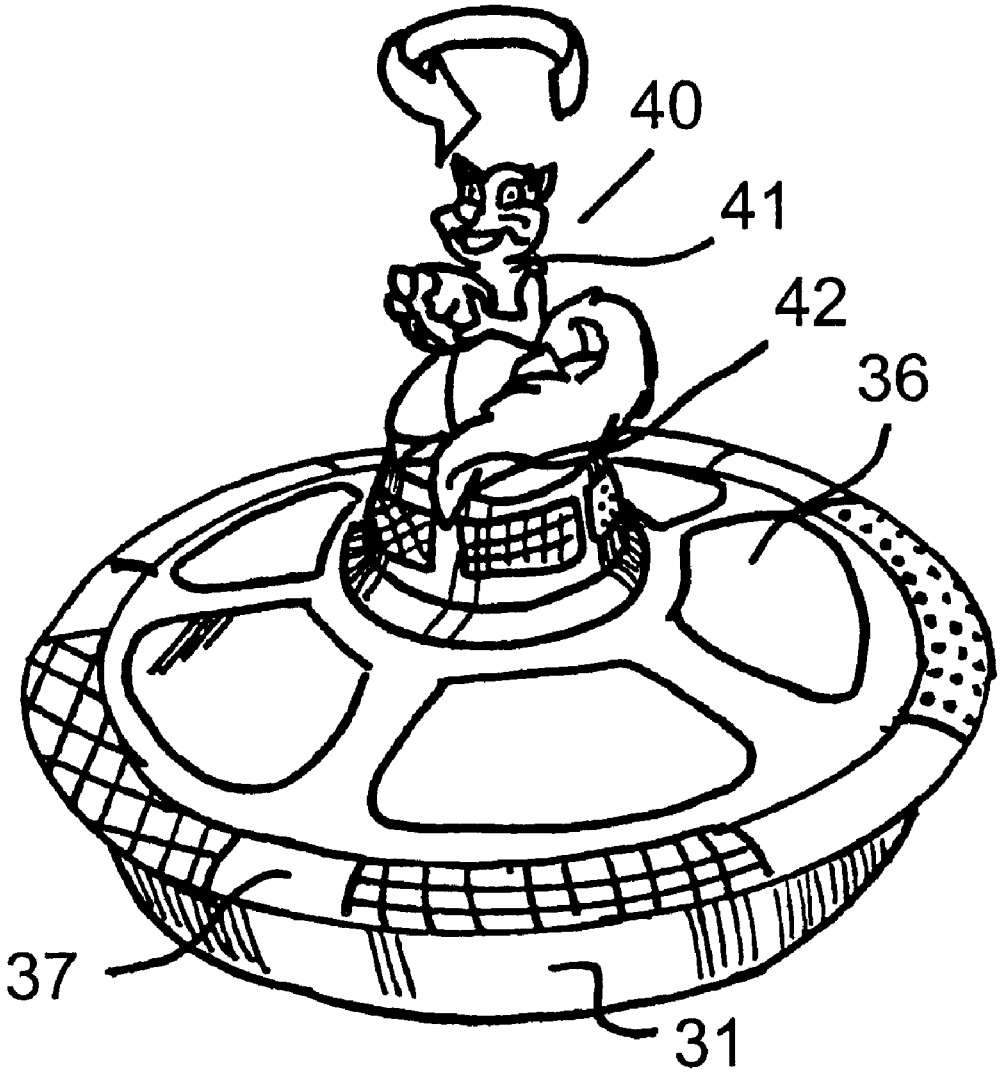
FIG. 10 is a perspective view of a further feeding bowl according to the invention.

Referring now to FIG. 10 there is illustrated an alternative construction of child's feeding bowl indicated generally by the reference numeral 40. This feeding bowl is of substantially the same construction in many respects as the feeding bowl 30 illustrated with reference to FIGS. 6 to 9 and thus the same reference numerals are used to identify similar parts. However, in this embodiment there is no motor, but there is provided a knob in the shape of a squirrel 41 having a tail 42 forming indicator means. The knob namely the squirrel 41 is rotatable about the central core and in this embodiment, thee is again a unique identifier for each compartment provided by colouring various portions of a cover plate 37. The feeding bowl 40 is used in substantially the same way as the feeding bowl 30, except that it is a simply rotatable indicator means which forms both the choice control means and its operating means. It operates in substantially the same as any roulette wheel. It will be appreciated that the food vessel 35 and hence the food compartments 36 no longer rotates.

Figure 11:
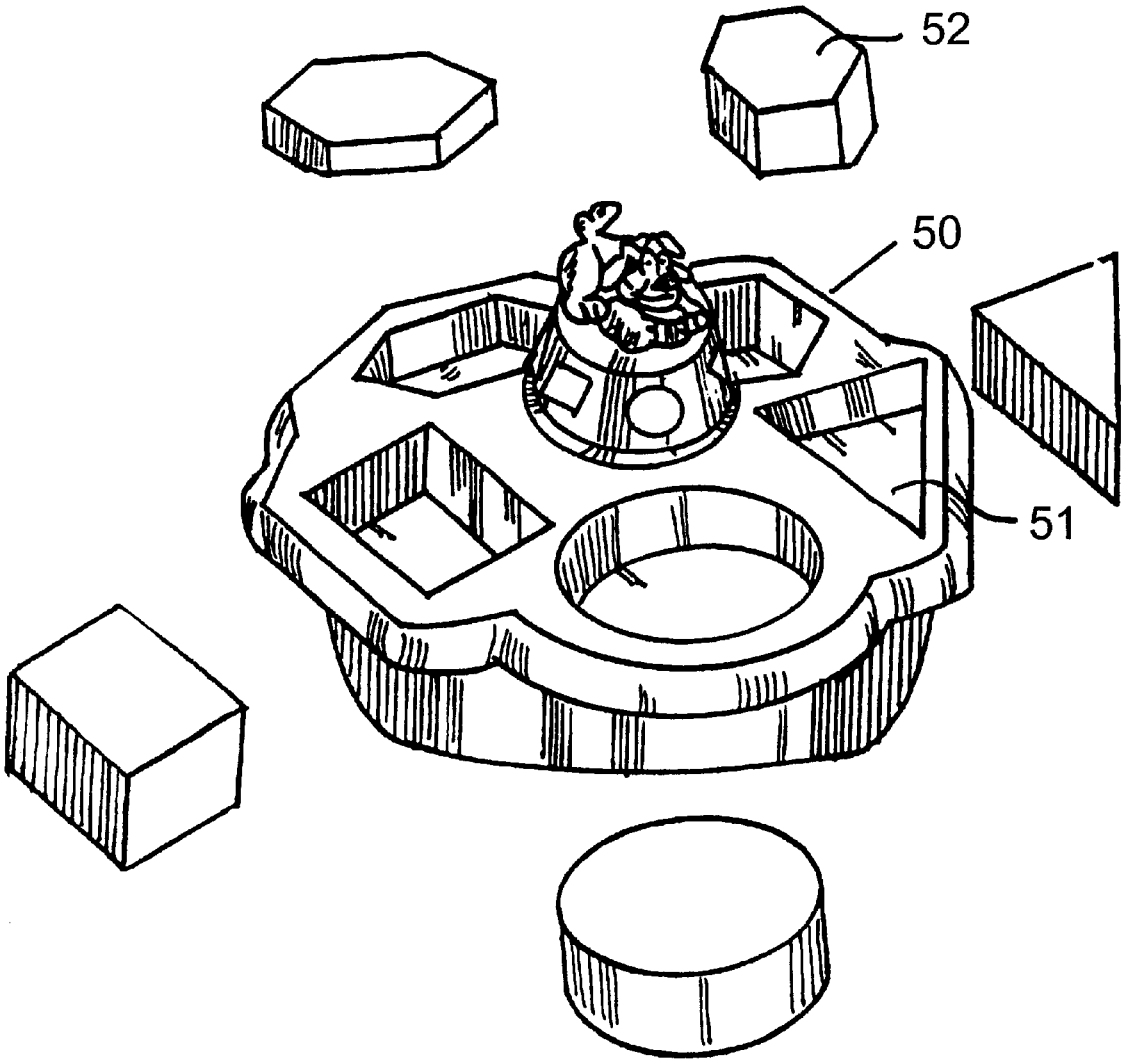
FIG. 11 is a perspective view of a still further feeding bowl according to the invention.
Figure 12:
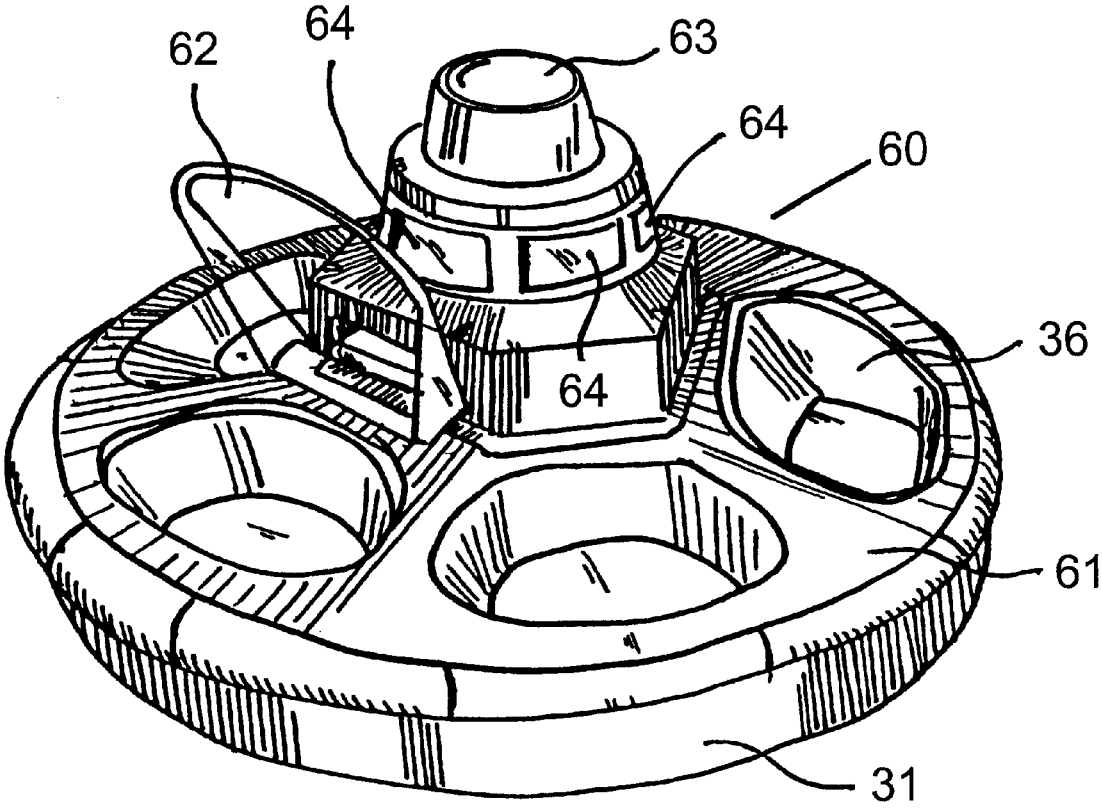
FIG. 12 is a perspective view of a further construction of feeding bowl according to the invention.

Referring now to FIG. 11 there is illustrated a still further construction of feeding bowl 50 identical in all substantial respect to the feeding bowls 30 and 40 and thus parts similar to those described with reference to FIGS. 6 to 10 inclusive are identified by the same reference numerals. In this embodiment, there are provided food compartments 51 of different geometric shapes in plan. There are also provided separate three dimensions shape members 52 which are of the same shape and slightly smaller size that the compartments 51. In this embodiment of the invention, when the child has finished playing the shapes 52 can be used as an educational toy to improve both cognitive and manipulative skills. feeding bowl indicated generally by the reference numeral 60 somewhat similar in construction to the feeding bowl 30 illustrated with reference to FIGS. 6 to 9 inclusive and accordingly parts similar to those described with reference this previous embodiment are identified by the same reference numerals. In this present embodiment, there is provided a cover plate 61 of a transparent material. The cover plate 61 incorporates a closure formed by a pivotal lid 62 actuated by a push-button 63. This push-button 63 forms parts of a control mechanism which includes a battery-powered electric motor not shown, mounted on the core. Beneath the push-button 63 is a plurality of coloured lights 64. In operation, as before, the food vessel 35 and its respective food compartments 36 rotate beneath the cover plate 61 on operation of the motor. When the motor stops the push-button 63 is activated to open the lid 62 and expose one of the food compartments 36. It will be appreciated that the push-button 63 could also be used to activate the motor and the motor itself on stopping could case the lid 62 to open. In other words the means to open the lid could be associated with the motor such that it opens on completion of rotation of the food compartments.

Figure 13:
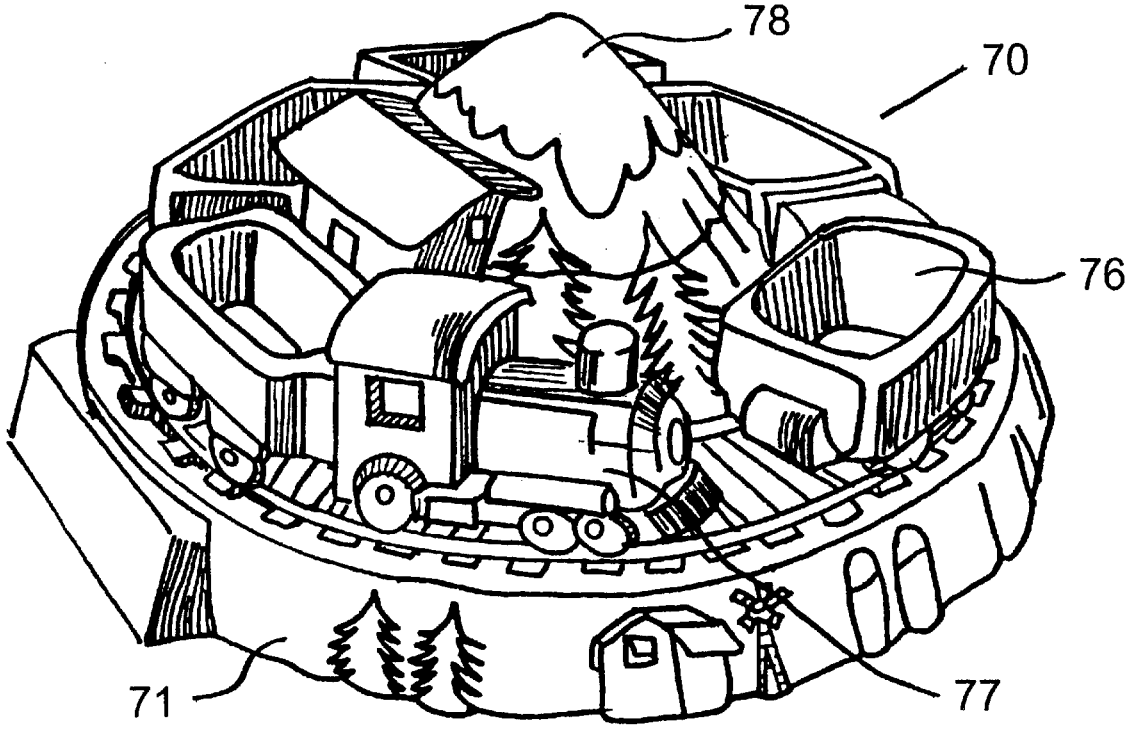
FIG. 13 is a perspective view of another feeding bowl according to the invention.
Figure 14:
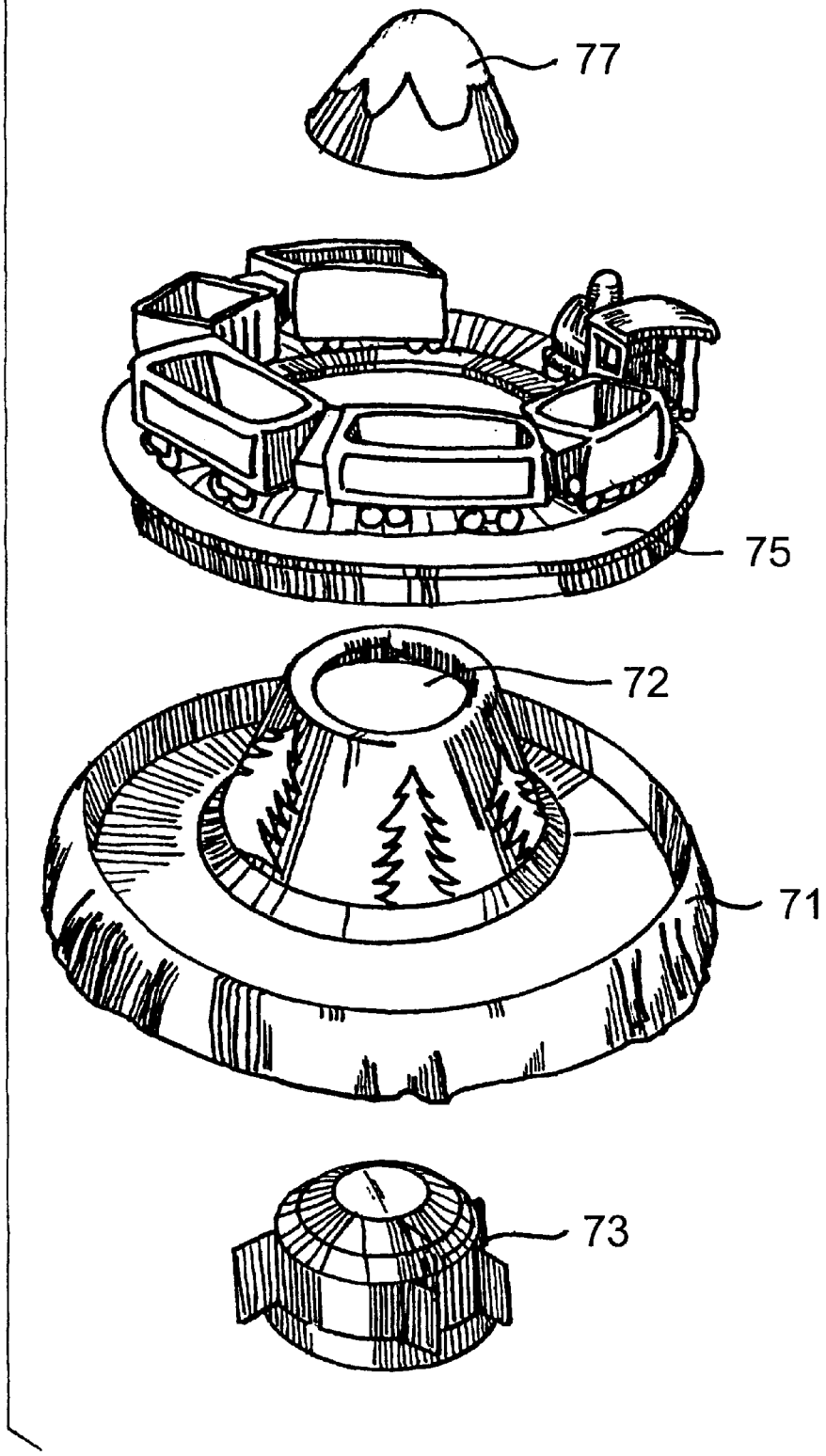
FIG. 14 is an exploded view of the feeding bowl of FIG. 13.

Referring now to FIGS. 13 and 14 there is illustrated an alternative construction of child's feeding bowl indicated generally by the reference numeral 70 comprising a base vessel 71 having a central core 72 mounting an electric motor 73. A separate turntable 75, representing in this embodiment a rail track is rotatably mounted around the core 72 and is connected by means not shown to the motor 73. A plurality of food compartments, in this embodiment provided by carriages 76 drawn by a train engine 77 are provided. It will be appreciated the train engine itself could also provide a compartment and that further lids or covers could be provided on each of the carriages 76. The central core 72 has mounted thereon a cover 78.

In use, the motor 73 operates to cause the turntable 75 to rotate and thus after the motor stops a carriage 76 will be in front of the child so that the child can eat the contents herein. When the contents of all the carriages have been eaten the child can be allowed to lift off the cover 78 and to take whatever treat or other surprise for the child has been previously placed in the central core 72. they are not, the cover 78 can be provided with means to lock it in place until all the carriages have been presented to the child for eating from. Indeed it will be appreciated, as mentioned above, that the carriages could include lids or covers which would only be opened on the carriage stopping in the correct position. Similarly, the cover could be so-linked to the motor. It will be appreciated that there are many way in which this could be carried out.

Figure 15:
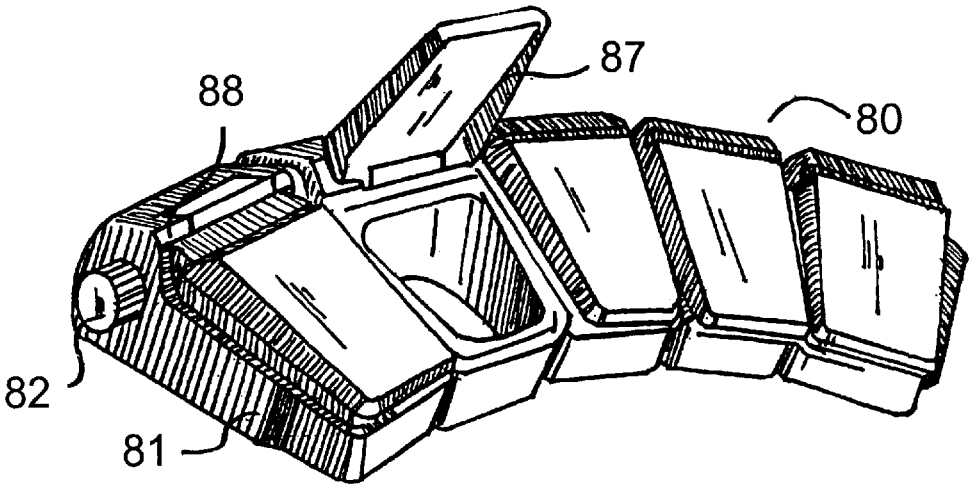
FIG. 15 is a perspective view of a still further bowl according to the invention.
Figure 15:
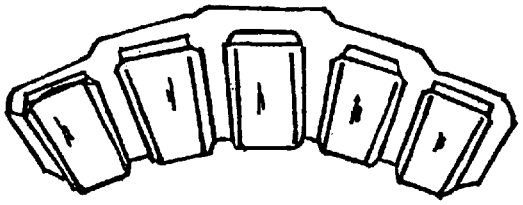
Figure 17:
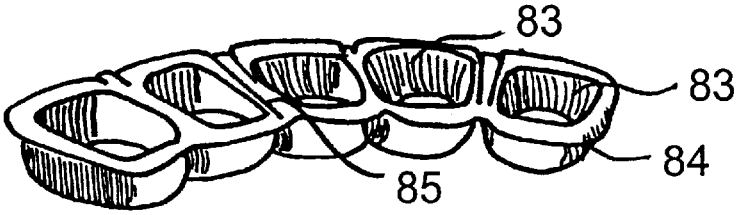
FIG. 17 is a plan view of the feeding bowl of FIGS. 15 and 16.
Figure 16:
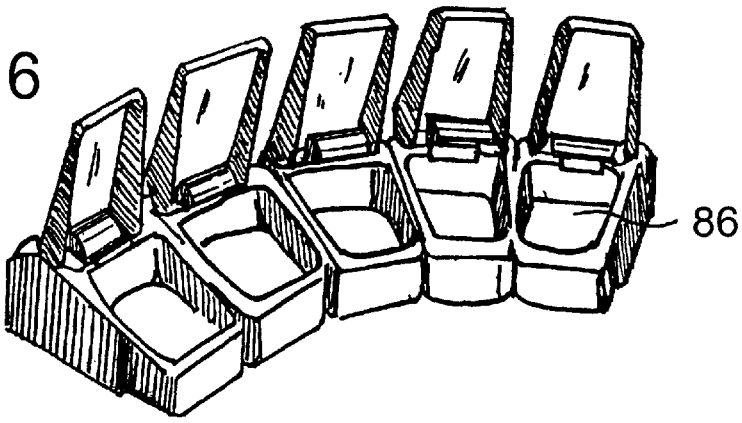
FIG. 16 is an exploded of the feeding bowl of FIG. 15.

Referring now to FIGS. 15 to 17 inclusive, there is illustrated a child's feeding bowl indicated generally by the reference numeral 80 comprising a base vessel 81 substantially arcuate in plan incorporated a battery-driver motor, not shown, actuated by a knob 82. A plurality of food compartments 83 are provided in a separate integral dish 84, again having a plurality of partition walls 85. The dish 84 is so-configured as can be seen from FIG. 16 as to removably engage inside recesses 86 in the base vessel 81. The base 81 carries a plurality of closures formed by lids 87, each mounted by a hinge 88 on the base vessel 81. Each lid 87 incorporates a light and is connected by suitable control means to the motor, or a battery again not shown. Further this feeding bowl incorporates a music player. Also not shown are biasing means which allow the hatches to pop open on the motor ceasing to operate. Thus, there is provided, again not shown, lock means for each biasing means connected to the chance control means which in this case is the motor. However, these feature may not be incorporated in each device. Thus, for example, it is not necessary to have flashing lights and music playing and one, both or neither may be used. Similarly, individual identification or unique identifier means may be provided for each lid, such as by colours, numbers, or character relief on the top of the lids. Indeed there are so many variations that it is almost impossible to recite them all.

It is also envisaged that particular indicia could be used such as the leg of a chicken, a banana, a burger/hotdog, a carrot or cartoon characters of indeed various detachable indicia could be used which indicia could be used depending on the particular meal being served by the parent or child carer. It is also envisaged that detachable rims could be used which detachable rims could be placed on the outer rim and could be used for any particular meal combination required. It will be appreciated that instead of a dice agitator, that any form of detachable bowl and dice could be placed on the central core or indeed the dice and dice agitator could be kept entirely separate from the bowl and simply used with the bowl when required.

While in the embodiments described above there is described feeding bowls divided into five or six compartments, there is nothing whatsoever suggesting that a bowl could not be divided into other numbers of compartments or that alternatively, a plurality of bowls could be used.

One of the great advantages is that the parent or child carer should be able to ensure that the child gets a particularly good mix of foods, thus ensuring that instead of having one particular food and eating it all at once, the child would be persuaded or effectively forced to vary from, for example, fish to vegetables to another form of vegetable to a cereal and the like.

The great advantage of the present invention is that it will turn eating into a game for the children. Obviously, children desire this. Anything that can increase the child's attention span is to be desired.

The child's feeding bowl can be made of any suitable dimensions as can the separate containers, ideally, however, such a bowl or plate should be at least 20 mm in depth where food is placed. Obviously, it is not necessary that plates or bowls be divided into a plurality of compartments or containers but ideally they should be. There is nothing to suggest that all compartments have to be of different sizes or the same size.

In an effort to teach children, for example, various letters and the like could be placed against various compartments and when the child identified the particular letter, they would be allowed eat from that particular compartment. A great advantage of this would be that it could act as a learning aid.

What is claimed is:

1. A child's feeding bowl comprising:

a base vessel;

a central core portion for the base vessel;

a plurality of side-by-side food compartments formed in a separate integral food vessel rotatable about the central core;

a motor for rotating the food vessel for selecting a food compartment for a child;

a cover formed from a substantially transparent material and removably mounted on the base vessel to cover the food compartments while leaving their contents visible;

a closure in the cover forming a pivotal lid to expose the contents of one food compartment;

means to open the lid on completion of rotation of the food vessel;

a plurality of different coloured lights mounted on the central core portion; and means to cause the lights to switch on and off as the food vessel rotates.

2. A child's feeding bowl as claimed in claim 1, wherein the means to open the lid comprises means associated with the motor to open the lid on completion of rotation of the food vessel.

3. A child's feeding bowl as claimed in claim 1, wherein the integral food vessel comprises a turntable with the food compartments formed therein, the closure is formed by a lid for each food compartment and in which the means to open the lid comprises means associated with the motor to allow opening of one of the lids on stopping of the turntable after rotation by the motor.

4. A child's feeding bowl as claimed in claim 3, wherein the food compartments formed in the turntable visually represent separate transport vehicle shapes, and in which the closure is formed by a portion of each food compartment.

5. A child's feeding bowl as claimed in claim 3, wherein the turntable represents a rail track rotatable about the central core portion, the food compartments formed on the turntable are visually represented by a train engine drawing carriages, and a further treat compartment having a treat closure formed in the central core portion associated with the motor and closure to allow opening of the treat closure when all the other closures have been opened.

6. A child's feeding bowl comprising:

a base vessel substantially arcuate in plan and including a plurality of side by side recesses forming compartment receiving sockets;

a plurality of food compartment formed in an integral dish having a plurality of partition walls the dish being configured to removably engage inside the recesses;

a lid forming a closure for each food compartment pivotally mounted on the base vessel support;

biasing means associated with each lid to cause the lid to open;

lock means for each lid;

a different colored indicated light associated with each compartment;

a motor forming a chance controlled means and for turning on and off the lights, whereby on the motor ceasing to operate the light remains on for a preset time period and simultaneously the lock means for the appropriate lid is released.

7. A child's feeding bowl as claimed in claim 6, further comprising a music player operable as the motor operates.

* * * * *